United States Patent [19]

Menocal

[11] 4,232,282

[45] Nov. 4, 1980

[54] CIRCUIT BREAKER HAVING MEANS TO FACILITATE ASSEMBLY THEREOF

[75] Inventor: Gustavo A. Menocal, Wilmington, N.C.

[73] Assignee: Gould Inc., Rolling Meadows, Ill.

[21] Appl. No.: 970,279

[22] Filed: Dec. 18, 1978

[51] Int. Cl.[3] ..... H01H 73/06

[52] U.S. Cl. ..... 335/202; 335/6

[58] Field of Search ..... 335/202, 6, 21, 35, 335/191, 201

[56] References Cited

U.S. PATENT DOCUMENTS

| | | | |
|---|---|---|---|
| 3,246,098 | 4/1966 | Hall | 335/35 |
| 3,464,040 | 8/1969 | Powell | 335/191 |
| 4,011,420 | 3/1977 | Heft | 335/201 |

*Primary Examiner*—Harold Broome

*Attorney, Agent, or Firm*—Harold Huberfeld

[57] ABSTRACT

A narrow molded case circuit breaker having a trip-free overcenter toggle contact operating mechanism wherein the contact operating spring is connected between the movable contact arm and releasable cradle, and the contact arm is pivotally connected to the manual operating member, is constructed in such a manner that prior to closing of the housing by its cover part, the movable contact arm is cocked with respect to the cradle. That is, when the circuit breaker is assembled, the movable contact arm and cradle are mounted for movement is generally parallel planes. However, before the housing cover is assembled to the housing base, the main spring moves the movable contact arm so that the plane thereof is at an angle with respect to the plane of the cradle. In order to limit this tilting or cocking, the cradle is provided with a blocking formation which is engaged by the movable contact arm so that cocking of the movable contact arm is limited to an acceptable degree.

10 Claims, 6 Drawing Figures

CIRCUIT BREAKER HAVING MEANS TO FACILITATE ASSEMBLY THEREOF

This invention relates to narrow molded case circuit breakers in general and more particularly relates to a construction thereof which facilitates assembly of the circuit breaker elements.

U.S. Pat. No. 4,011,420 issued Mar. 8, 1977 to E. B. Heft for a Molded Case Circuit Breaker With Improved Interrupting Capacity describes a ½" wide molded case circuit breaker having a spring powered trip free overcenter toggle contact operating mechanism. In this circuit breaker the movable contact arm is pivoted directly on the manual operating member and a coiled tension spring is connected between the contact arm and the releasable cradle of the contact operating mechanism. Conditions within the circuit breaker housing are so cramped that mounting of the elements within the circuit breaker housing presents certain difficulties. In particular, difficulty is presented because the reaction force between the cradle and movable contact arm tends to cock the latter.

In accordance with the instant invention this same general type of circuit breaker mechanism is utilized but assembly thereof is facilitated by providing a tab on the cradle which engages the movable contact arm during the assembly operation and cooperates therewith to limit cocking of the movable contact arm to an acceptable extent. That is, cocking of the movable contact arm will be limited to a point where the likelihood of disengagement between the contact arm and manual operating member is substantially reduced.

Accordingly, a primary object of the instant invention is to provide a novel construction for a relatively narrow molded case circuit breaker.

Another object is to provide a construction for a circuit breaker of this type wherein assembly of the circuit breaker elements is facilitated.

A further object is to provide a circuit breaker of this type in which means are provided to limit cocking of the movable contact arm during assembly of the circuit elements.

These objects as well as other objects of this invention shall become readily apparent after reading the following description of the accompanying drawings in which.

Figure 1:
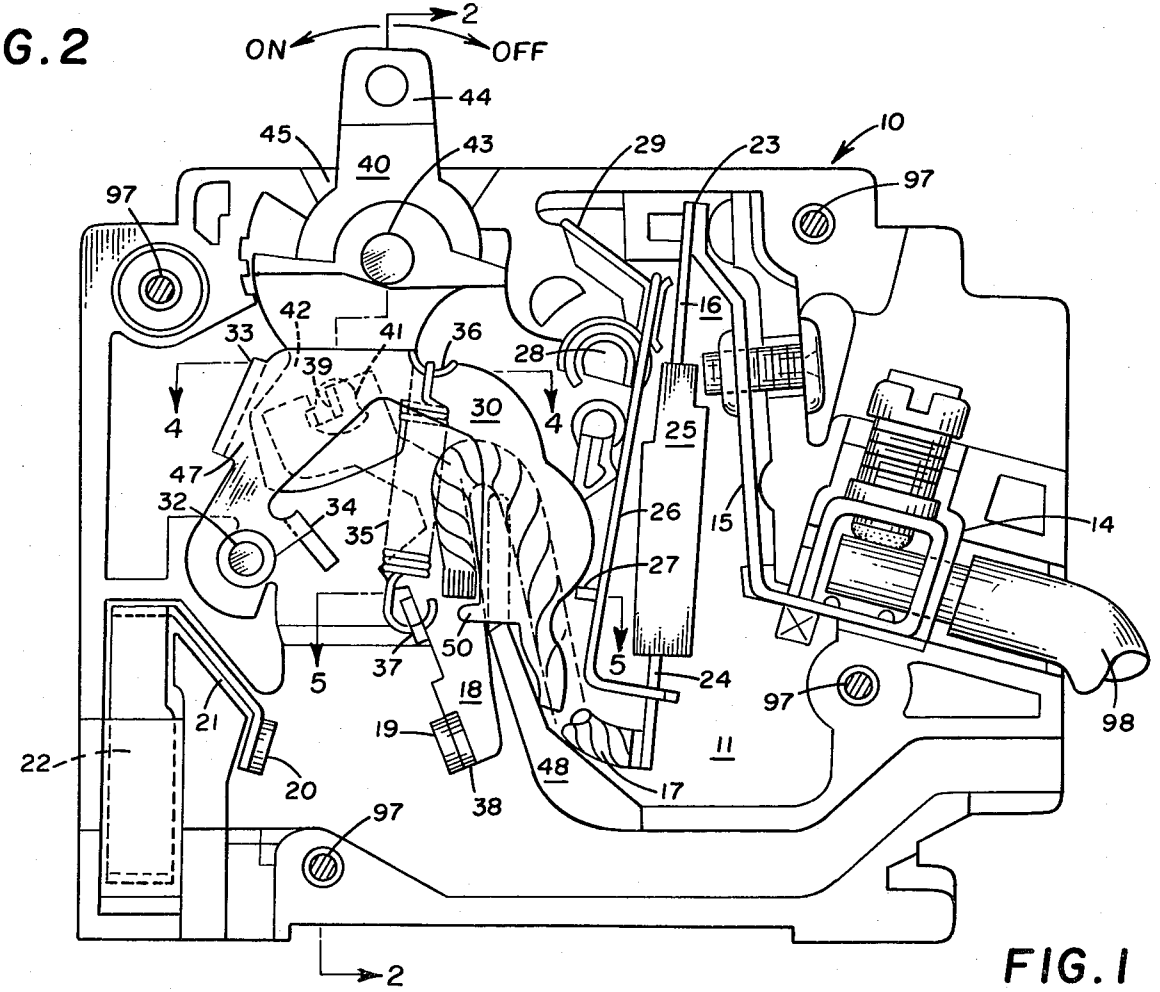
FIG. 1 is a side elevation of a circuit breaker constructed in accordance with teachings of the instant invention, with the side cover removed to reveal the current carrying and contact operating elements.

Now referring to the Figures. Circuit breaker 10 is provided with a molded insulating housing including base 11 which is open at one side thereof and, in a manner well known to the art, is provided with internal formations to operatively position the current carrying and contact operating elements of circuit breaker 10. Housing cover 12 mates with base 11 at line 13 to close the open side of base 11, and cooperates with base 11 to define internal chamber 99 wherein the circuit breaker current carrying and contact operating elements are disposed.

The current carrying path through circuit breaker 10 consists of wire grip 14 for load conductor 98, conducting strap 15, bimetal 23, flexible conducting braid 17, movable contact arm 18, movable contact 19 on transverse ear 38 of arm 18, stationary contact 20, conducting strap 21 and line contact 22.

The upper or forward end 23 of bimetal 16 is fixedly mounted to the forward end of strap 15. Bimetal 16 extends rearward between the arms of stationary magnetic yoke 25 with rear end 24 of bimetal 16 engaging the outwardly turned rear end of magnetic armature 26. The latter is pivotally mounted at its other end on internal base protrusion 28. Formed leaf spring 29 biases armature 26 in a clockwise direction with respect to FIG. 1 so that latch 27 carried by armature 26 is biased toward its latching position shown in FIG. 1. In a manner well known to the art, latch 27 is engageable with latching tip 31 of cradle 30 which is pivotally mounted on internal base formation 32 located at the end of cradle 30 remote from latching tip 31.

Cradle 30 is generally of C-shape facing rearward and is substantially planar, having transverse reset ear 33 and transverse contact kicker ear 34. The outer edge of cradle 30 is notched at 36 to receive the forward end of main contact operating spring 35 whose rear end is connected to transverse ear or tab 37 formed integrally with movable contact arm 18. Spring 35 is a coiled tension member which is at least partially loaded for all positions of the contact operating elements of circuit breaker 10. Thus, spring 35 biases contact arm pivot ear 39 in a forward direction. The latter is received by aperture 41 in rear portion 42 of operating member 40. Portion 42 is relatively narrow and is interposed between arm 18 and cradle 30. Manually engageable front portion 44 of operating member 40 extends externally of housing 11, 12 through front opening 45 thereof. Aligned bearing apertures 43, 43 project from opposite sides of operating member 40 and are received by circular depressions formed in the inner surfaces of base 11 and cover 12 to pivotally mount member 40 for movement between the On and Off positions of circuit breaker 10 defined by the end portions of aperture 45.

In a manner well known to the art, in order to operate cradle 30 from its tripped position shown in FIG. 1 to its reset position wherein latching tip 31 is supported by the forward surface of latch 27, operating member 40 is manually operated in a clockwise direction. This causes edge 40 of rear portion 42 to engage reset ear 33 and pivot cradle 30 in a counterclockwise direction about its pivot 32. Thereafter, pivotal movement of operating member 40 serves to reposition pivot ear 39 of movable contact arm 18 on opposite sides of the line of action for main spring 35 so that the latter is effective to bring about engagement and disengagement of cooperating contacts 19, 20 when operating member portion 44 is in the respective On and Off positions.

Figure 2:
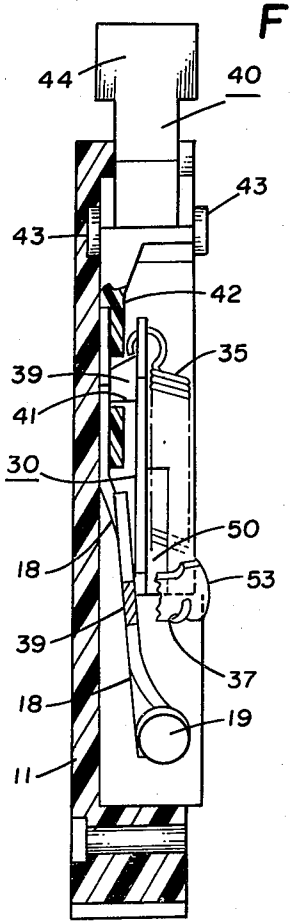
FIG. 2 is a cross-section taken through line 2—2 of FIG. 1 looking in the direction of arrows 2—2.
Figure 4:
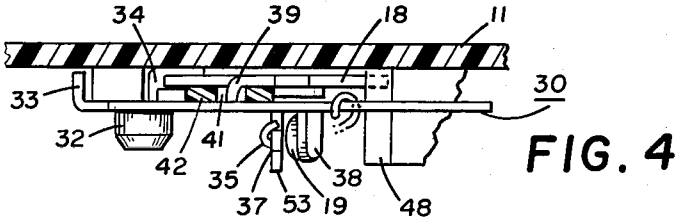
FIG. 4 is a fragmentary cross-section taken through line 4—4 of FIG. 1 looking in the direction of arrows 4—4.
Figure 5:
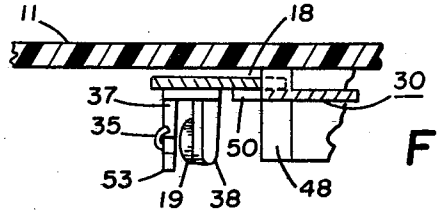
FIG. 5 is a fragmentary cross-section taken through line 5—5 of FIG. 1 looking in the direction of arrows 5—5.
Figure 6:
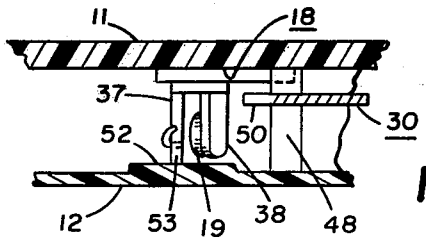
FIG. 6 is a fragmentary cross-section taken through line 5—5 of FIG. 1 looking in the direction of arrows 5—5, with the side cover in place.

The occurrence of predetermined fault current conditions is effective to pivot armature 26 counterclockwise thereby causing latch 27 to release latching tip 31. This permits main spring 35 to operate cradle 30 to its tripped position shown in FIG. 1 wherein it is held by internal stop formation 48 of base 11. Now operating member portion 44 is in its trip indicating position intermediate its On and Off positions, as shown in FIG. 1. In order to construct circuit breaker 10 the current carrying and contact operating elements thereof are mounted in base 11 through the open side thereof and assume the positions shown in FIG. 1. In this position, operating member 40 is in its mid or trip indicating position, cradle 30 is pivoted clockwise to its tripped position, movable contact arm 18 is in contact open position engaging stop 48. Main operating spring 35, although slightly stretched, is less loaded than when cradle 30 is in its reset position with latch 27 supporting latching tip 31. With the elements in the position of FIG. 1, a force component exerted by spring 35 biases the rear contact carrying end of arm 18 toward the open side of base 11. However, movement of contact arm 18 toward the open side of base 11 is limited by blocking formation 50 on cradle 30. The latter engages movable contact arm 18 to limit its movement to the cocked position shown in FIG. 2 wherein the main planar portions of movable contact arm 18 are disposed at a slight angle with respect to the plane of cradle 30.

Figure 3:
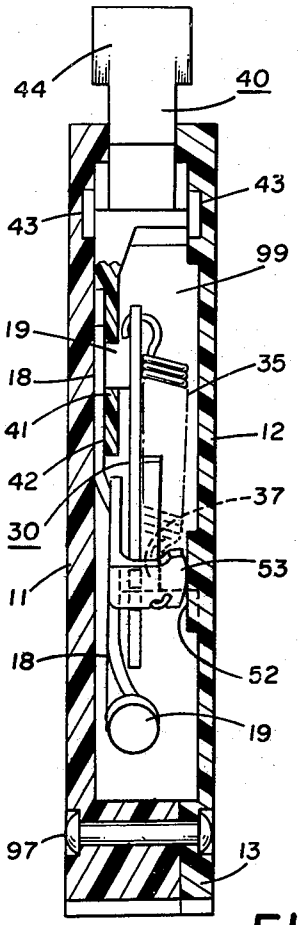
FIG. 3 is a cross-section taken through line 2—2 of FIG. 1 looking in the direction of arrows 2—2, with the side cover in place.

As seen in FIG. 1, blocking ear or tab 50 is in the general vicinity of latching tip 31 and extends from the inner edge of cradle 30 toward its pivot 32. When cover 12 is mounted to base 11 and secured thereto by a plurality of rivets 97, interior surface formation 52 of cover 12 engages free end 53 of contact arm ear 37 and forces contact arm 18 to assume the operative position shown in FIG. 3 wherein arm 18 and cradle 30 will pivot in generally parallel planes at right angles to pivot axis 43 for operating member 40.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. A circuit breaker including a stationary contact, a movable contact, an arm having said movable contact mounted on one end thereof, a cradle mounted for movement between a reset and a tripped position, a latch for holding said cradle in said reset position, trip means for automatically releasing said latch responsive to the occurrence of predetermined fault current conditions, an operating member to which the other end of said arm is pivotally connected, a main spring connected between said cradle and said arm and exerting a force component biasing the latter lengthwise toward said operating member, a narrow molded insulating housing defining a chamber, said housing including a base having an open side and integral formations for operatively positioning the previously recited elements of said circuit breaker within said chamber with a manually engageable forward handle portion of said operating member extending outside of said housing through a front opening thereof, said housing also including a cover closing the open side of said base; with said cradle in said reset position, said handle portion being movable between On and Off positions to reposition the other end of said arm relative to the line of action of said spring whereby force exerted by the latter is effective to move said arm and bring about respective closing and opening of said contacts; with said cradle in said tripped position, said spring moving said arm to a contact open position and said handle portion to a trip indicating position intermediate said On and Off positions; with said cradle in said tripped position, said handle portion in said trip position and said cover removed, said spring providing a force component biasing said one end of said arm toward said open side and into engagement with a blocking formation of said cradle; said blocking formation limiting movement of said arm toward said open side; said arm having a transverse projection extending toward said open side; with said cover closing said open side, the inside of said cover engaging said transverse projection to force said arm away from said open side and disengage said arm from said blocking formation.

2. A circuit breaker as set forth in claim 1 in which the cradle is generally C-shaped and faces rearward with one end of said cradle having a latching tip engageable by said latch; pivot means at the other end of said cradle pivotally mounting said cradle to said housing.

3. A circuit breaker as set forth in claim 2 in which the blocking formation is in the region of said latching tip and projects toward said pivot means.

4. A circuit breaker as set forth in claim 3 in which said spring is a coiled tension member having one end connected to said transverse projection and the other end connected to said cradle at a point between said tip and said pivot means.

5. A circuit breaker as set forth in claim 4 in which said blocking formation engages said cradle in the region of said transverse projection.

6. A circuit breaker as set forth in claim 5 in which a portion of said operating member is interposed between said cradle and the other end of said arm.

7. A circuit breaker as set forth in claim 6 in which the operating member is mounted on a pivot axis extending widthwise of said housing.

8. A circuit breaker as set forth in claim 7 wherein with said cover closing said open side, said arm and said cradle move in generally parallel planes positioned generally perpendicular to the pivot axis for said operating member.

9. A circuit breaker as set forth in claim 8 wherein with said cover removed, said arm is disposed generally in a plane disposed at an angle with respect to a plane wherein the major portion of said cradle is disposed.

10. A circuit breaker as set forth in claim 9 in which the other end of the spring is engaged to said cradle in a notch formed in the outer edge of said cradle.

* * * * *